US005663519A

United States Patent [19]

Müller

[11] Patent Number: 5,663,519

[45] Date of Patent: Sep. 2, 1997

[54] BREECH FOR A GUN WHICH IS ABLE TO OPERATE WITH TWO DIFFERENT BREECH BLOCKS

[75] Inventor: Ernst Johann Heinrich Müller, Pretoria, South Africa

[73] Assignees: Denel (Proprietary) Limited, South Africa; Octrooibureau Kisch N.V., NL-Curacao

[21] Appl. No.: 635,970

[22] PCT Filed: Nov. 7, 1994

[86] PCT No.: PCT/NL94/00276

§ 371 Date: May 6, 1996

§ 102(e) Date: May 6, 1996

[87] PCT Pub. No.: WO95/13513

PCT Pub. Date: May 18, 1995

[30] Foreign Application Priority Data

Nov. 8, 1993 [ZA] South Africa ..... 93/8306

[51] Int. Cl.[6] ..... F41A 3/00

[52] U.S. Cl. ..... 89/17; 89/24; 89/26

[58] Field of Search ..... 89/17, 24, 26; 42/14

[56] References Cited

U.S. PATENT DOCUMENTS

| | | | |
|---|---|---|---|
| 3,776,095 | 12/1973 | Atchisson | 89/128 |
| 4,404,888 | 9/1983 | Gentiluomo | 89/26 |
| 4,548,121 | 10/1985 | Janssen et al. | 89/26 |

FOREIGN PATENT DOCUMENTS

| | | |
|---|---|---|
| 41 695 | 5/1887 | Germany . |
| 32 47 744 | 6/1984 | Germany . |
| 34 22787 | 1/1986 | Germany . |
| 15309 | of 1911 | United Kingdom . |

*Primary Examiner*—J. Woodrow Eldred

*Attorney, Agent, or Firm*—Nikaido Marmelstein Murray & Oram LLP

[57] ABSTRACT

A modular concept for a gun which uses a breech conversion kit allows the firing of cased and caseless ammunition with the same gun. The cannon has 2 breech mechanism (10) which includes a first sliding breech-block (19) which engages the rear end (15) of a cartridge case in the firing position. Said first sliding breech-block (19) is interchanged for a second sliding breech-block (21) when firing caseless ammunition. Said second breech-block is in contact with a scaling member (23) which is mounted pivotally on an axis (27) which is located on the upper face of breech ring (11).

9 Claims, 4 Drawing Sheets

BREECH FOR A GUN WHICH IS ABLE TO OPERATE WITH TWO DIFFERENT BREECH BLOCKS

This invention relates to the breech of a cannon or the like.

Two types of ammunition are generally available for cannons: a first type known as cased ammunition in which the case carries the propellant charge, and a second type known as caseless ammunition which does not have such a case and for which the propellant charge has to be loaded separately into the firing chamber of the cannon.

The breech of the conventional cannon is adapted to handle only one of the aforesaid types of ammunition and different cannons are accordingly employed for shooting cased and caseless ammunition.

The conventional cannon breech usually includes a sliding block which is slidably movable in a transverse direction relative to the longitudinal axis of the firing chamber of the cannon from one position (hereafter referred to as the operative position) where it serves to seal off the rear end of the firing chamber of the cannon when the cannon is in the firing position, to a second position (hereafter referred to as inoperative position) where it does not.

Where the cannon is of the type which fires cased ammunition, the said sliding block serves to support the rear end of an ammunition case loaded into the firing chamber of the cannon and to effect the aforesaid sealing off action in cooperation with such rear end.

Where the cannon is of the type which employs caseless ammunition, an additional sealing means has to be employed for sealing off the rear end of the firing chamber.

It will be appreciated that because the breech of the conventional cannon is adapted only to fire one of the aforesaid two types of ammunition, it restricts the usefulness of such a cannon. It is accordingly an object of this invention to provide an arrangement with which this problem can be overcome or at least minimised.

According to the invention a breech for a cannon is provided which includes two interchangable sliding blocks, a first one which can in conventional manner in the operative position support and cooperate with the rear end of the case of cased ammunition located in the firing chamber of the cannon to seal the rear end of such chamber off when the cannon is in the firing position, and a second one which is adapted in the operative position to trap a sealing member in engagement with the said rear end of the firing chamber.

It will be appreciated that a cannon with such a breech will be able to fire both cased and uncased ammunition simply by employing the appropriate sliding block in the breech of the cannon.

Further according to the invention the sealing member includes a substantially semi-ball shaped plug which can fit removably into the rear end of the bore of the firing chamber, the plug including over its outer circumference sealing means for releasably engaging the inside rim of the said bore.

Preferably the sealing means comprises a so called De Bange obturation system.

Further according to the invention the sealing member includes a centrally located axially extending hole which communicates with the inside of the firing chamber when the plug is located in its bore, the said hole providing a path or flash channel through which a propellant charge located in the firing chamber can be ignited.

Still further according to the invention the sealing member is connected to one end of an elongated lever of which the other end is pivotally connected to the cannon breech ring.

With this arrangement the sealing member can be swung pivotally from one or operative position where the plug is located in the bore of the firing chamber, to a second or inoperative position where it is located outside the breech of the cannon.

It will be appreciated that such an arrangement provides for an increase in the firing rate of such a cannon to a level comparable with that of a conventional cannon intended for firing caseless ammunition.

Preferably the said free end of the lever is mounted on a transversely extending shaft of which the ends are rotatably mounted on or in the breech ring of the cannon.

The invention also includes within its scope a method of converting an existing conventional cannon which is either of the type capable of firing cased ammunition only, or of the type capable of firing caseless ammunition only, to one capable of firing both types in the manner set out above, as well as to a cannon which has been so modified.

It will be appreciated that because of the relatively simple modifications which are required, the arrangement lends itself to a very rapid conversion of such a conventional cannon to a cannon according to the invention.

The invention will now be described further by way of example with reference to the enclosed drawings in which.

Referring to all the drawings, the breech mechanism 10 of a cannon comprises a breech ring 11 which defines a trough like elongated channel 12 of which the one end communicates with the rear end of the bore of the firing chamber 13 of a cannon of which the rest of the details are not shown.

Figure 1:
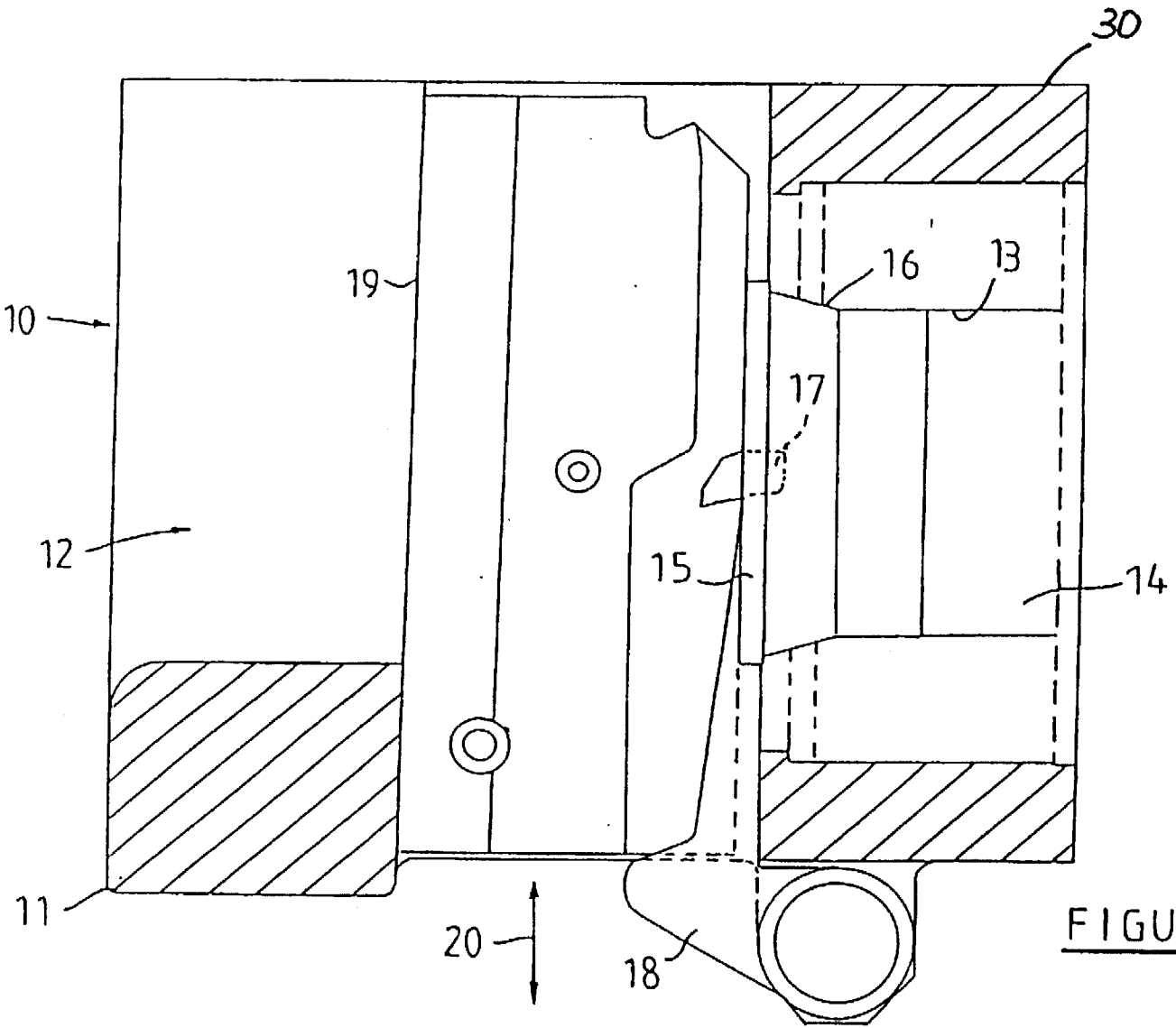
FIG. 1 is a diagrammatic longitudinal section through the breech and associated parts of a conventional cannon adapted for firing cased ammunition only, the sliding block of the breech being shown in the operative position.

In the arrangement shown in FIG. 1, breech mechanism 10 is that of a cannon intended to fire cased ammunition 14 only. Such ammunition can be loaded via channel 12 of breech ring 11 into firing chamber 13 so that the rear end 15 of the case 16 of ammunition 14 engages the surrounds of the bore of chamber 13 from where it can be extracted by the lug 17 of an extractor 18 after a shot had been fired.

Figure 3:
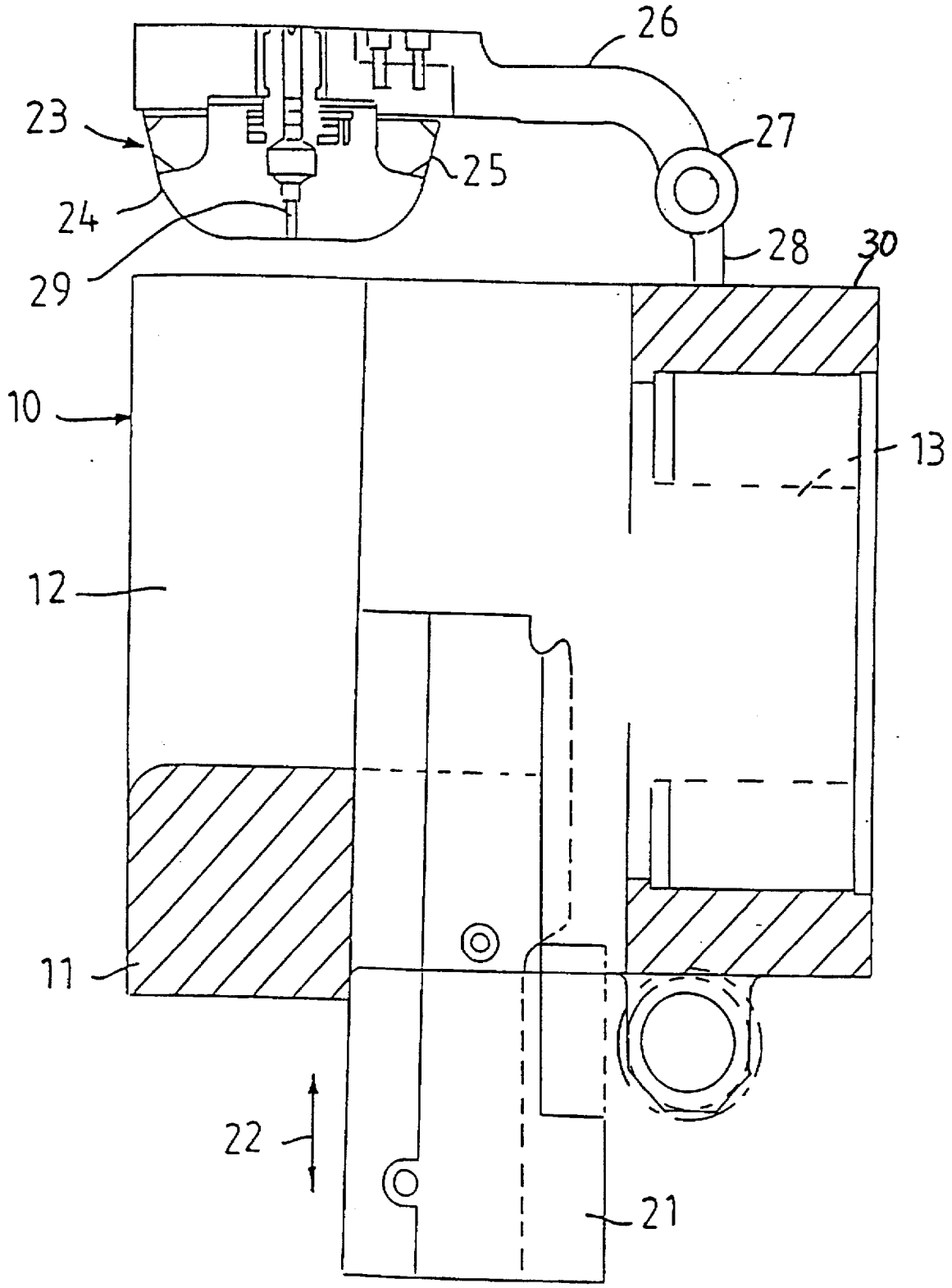
FIG. 3 is a similar view as that of FIG. 2, with the breech shown in the in-operative position.
Figure 4:
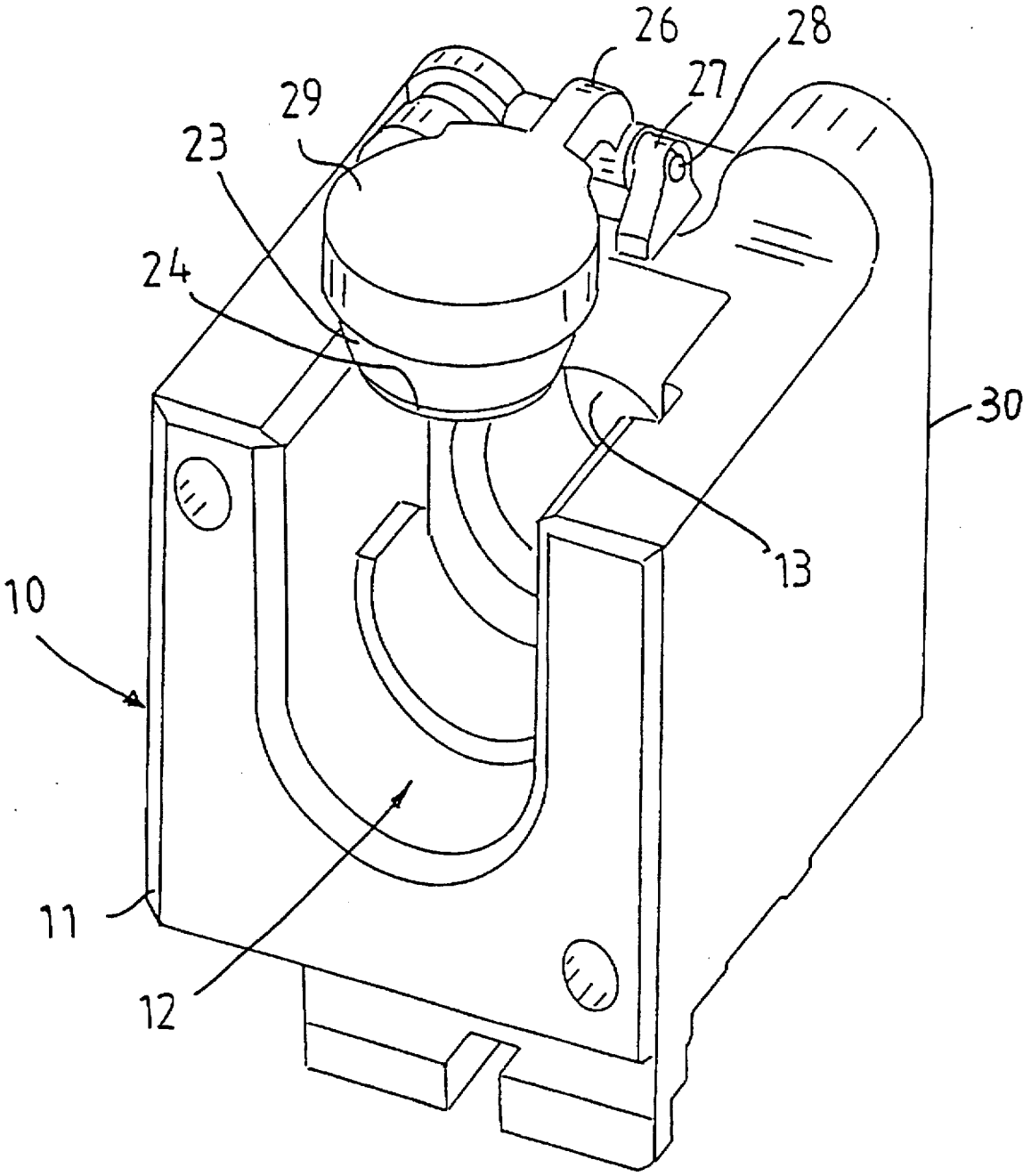
FIG. 4 is a diagrammatic perspective view of the breech of FIG. 3.

Breech mechanism 10 of the embodiment of FIG. 1 includes a conventional type sliding block 19 which is reciprocally slidable in the direction of arrow 20, i.e. transversely relative to the longitudinal axis of chamber 13, from a first or operative position shown in FIG. 1, to a second or inoperative position similar to that shown in FIGS. 3 and 4 for a sliding block 21.

When block 19 is in the operative position shown in FIG. 1, its leading end frictionally engages the rear end 15 of case 16 to support it and to cooperate with it to seal off the rear end of the bore of chamber 13 while the cannon is in the firing position.

When the shot had been fired, block 19 slides to its inoperative position and at the same time case 16 of the spent ammunition is ejected by the lug 17 of extractor 18 from chamber 13 via breech ring 11.

The cannon can then be reloaded in conventional manner.

Figure 2:
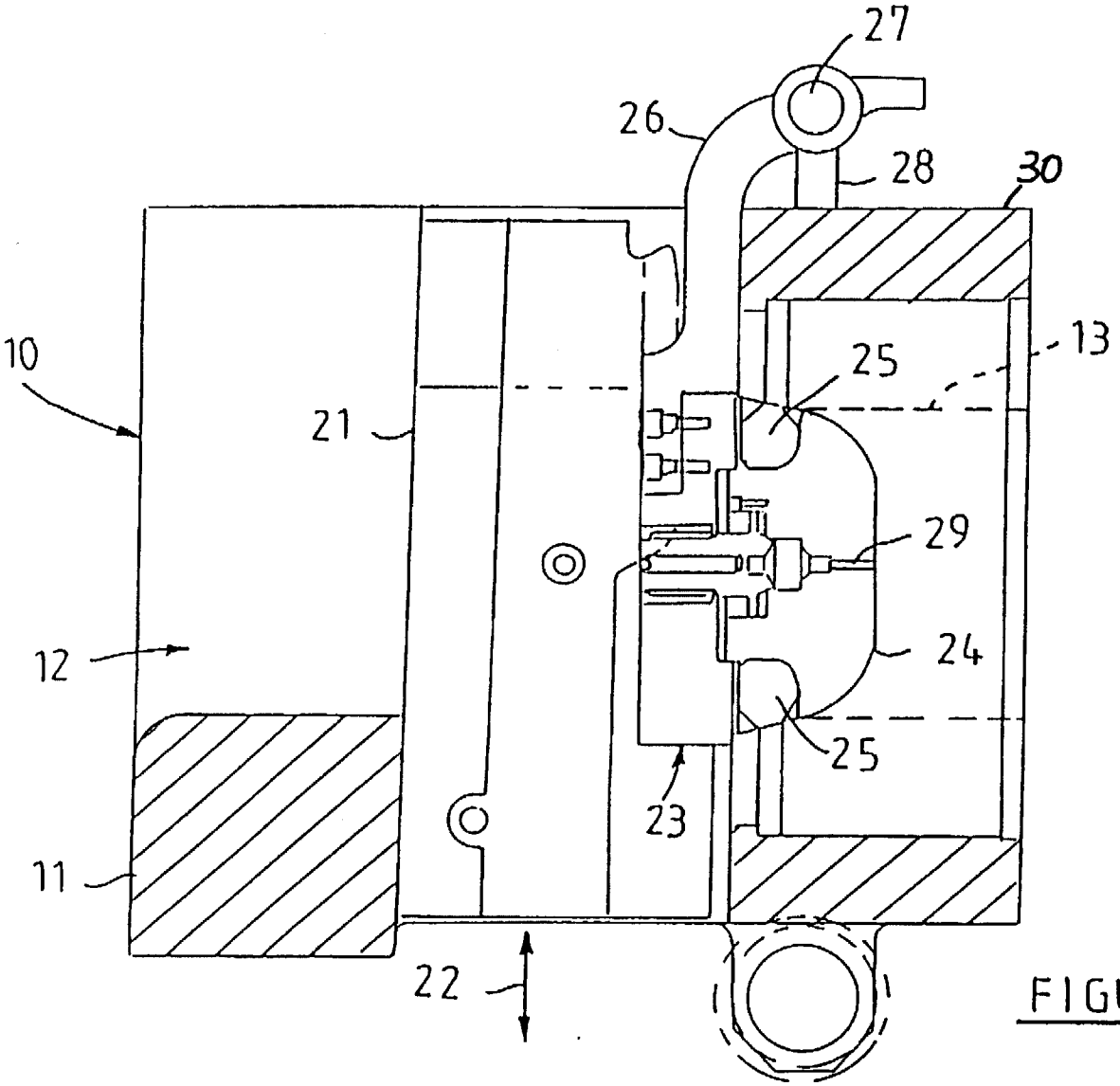
FIG. 2 is a similar view as that of FIG. 1 of one embodiment of a breech according to the invention, shown in the operative position.

In the arrangement shown in FIGS. 2 to 4, in which some of the details of lug 17 and extractor 18 have been omitted for clarity purposes, a modified block 21 is provided which, similar to block 19, is reciprocally movable in the direction of arrow 22 between its operative position, shown in FIG. 2, and its inoperative position shown in FIGS. 3 and 4. In this arrangement, which is intended for utilisation in a cannon which can fire both cased and caseless ammunition, sliding block 21 is of such width that when it is in its aforesaid operative position (FIG. 2) it can trap a sealing member 23 in the mouth of the rear end of the bore of firing chamber 13 to seal the latter off while the cannon is in the firing position.

Sealing member 23 comprises a substantial semi-ball shaped plug 24 which can pass into the bore of chamber 13 and which is provided over its outer circumference with a sealing system 25 of the so called De Bange obturation—type which can sealingly engage the inside rim of the mouth of the bore of chamber 13.

Plug 24 is connected to one end of an elongated lever 26 of which the other end is connected to a shaft 27 of which the ends are rotatably contained between two spaced apart protrusions 28 mounted on the upper face of breech ring 11. It will be appreciated that in an alternative arrangement the ends of shaft 27 may be contained rotatably within breech ring 11.

Sealing member 23 is hence pivotally movable from a first or operative position shown in FIG. 2, where it seals off the mouth of the bore of chamber 13 when the cannon is in the firing position, to a second or inoperative position, shown in FIGS. 3 and 4, where it is located outside breech ring 11 when the cannon is not in the firing position.

Sealing member 23 includes a centrally located passage 29 which serves as the flash channel through which the propellant charge located inside chamber 13 can be ignited when the cannon is fired.

It will hence be appreciated that when the cannon of FIGS. 2 to 4 is intended to fire cased ammunition 14, sliding block 19 is employed with sealing member 23 being pivoted to its inoperative position.

When the cannon has to fire caseless ammunition, block 21 and sealing member 23 are utilised in the manner described above. Because of the simplicity of operation of such a sealing member 23, the firing rate of a cannon utilising it is more rapid than that of the conventional type of cannon intended for firing caseless ammunition.

It will be appreciated that apart from including such a dual purpose breech system on newly manufactured cannons, existing cannons may also be modified to incorporate such sliding blocks 19 and 21 and sealing member 23. For this purpose such sliding blocks 19 and 21 and sealing member 23 may be supplied as a loose kit. It is also intended for the scope of this invention to extend to such a kit. Because of the ease and simplicity with which such a kit can be fitted to an existing cannon of the cased or caseless type, the conversion can be effected very rapidly.

It will be appreciated further that there are no doubt many variations in detail possible with a breech for a cannon, a cannon, a kit and method according to the invention without departing from the spirit and/or scope of the appended claims.

I claim:

1. A kit for a breech of a cannon having a firing chamber with a bored rear end into which cased or caseless ammunition can be loaded, the kit comprising (1) a first sliding block, for use with cased ammunition having a rear end which is located at the rear end of the firing chamber, wherein when the first sliding block is located in the breech of the cannon, the first sliding block is movable from an operative position, wherein the first sliding block supports and cooperates with the rear end of the cased ammunition to seal the rear end of the firing chamber, to an inoperative position, wherein the rear end of the firing chamber is unsealed, (2) a second sliding block, wherein the first sliding block and the second sliding block are interchangeable in the breech of the cannon, and (3) a sealing member, movably connectable to the cannon, wherein the second sliding block and the sealing member are for use with caseless ammunition, wherein when the second sliding block is located in the breech of the cannon, the second sliding block is movable from an operative position, wherein the second sliding block engages the sealing member to trap the sealing member in sealing engagement with the rear end of the firing chamber to seal the rear end of the firing chamber, to an inoperative position wherein trapping the sealing member in sealing engagement is avoided.

2. The kit of claim 1, wherein the sealing member comprises a plug member which is removably fitable into the rear end of the firing chamber and has one end adjacent the rear end of the firing chamber and the other end distant the rear end of the firing chamber, has a circular-cross section taken on an axis perpendicular to the ends and having a taper such that the cross section adjacent the one end is greater than the cross section adjacent the other end, and includes, contacting an outer surface thereof, sealing means for releasably sealing the rear end of the firing chamber.

3. The kit of claim 2, wherein the sealing means comprises an obturation system.

4. The kit of claim 2, wherein a centrally-located axially-extending hole is defined in the sealing means, wherein the hole communicates with the firing chamber when the sealing means is fitted in the rear end thereof and provides a path through which a propellant charge located in the firing chamber is ignitable.

5. The kit of claim 1, wherein the sealing member is connected to one end of an elongated lever of which the other end thereof is pivotally connected to the cannon.

6. The kit of claim 5, wherein the other end of the elongated lever is mounted on a transversely extending shaft having two opposite ends which are rotatably mounted on the cannon.

7. A method of converting a cannon, having a firing chamber with a bored rear end and a breech containing therein an original sliding block which renders the cannon capable of firing only cased ammunition, to a cannon capable of alternatively firing cased and caseless ammunition, comprising reversibly substituting the original sliding block with (1) a second sliding block which is interchangeable with the original sliding block, and (2) a sealing member, movably connectable to the cannon, wherein the second sliding block and the sealing member are for use with caseless ammunition, wherein when the second sliding block is located in the breech of the cannon, the second sliding block is movable from an operative position, wherein the second sliding block engages the sealing member to trap the sealing member in sealing engagement with the rear end of the firing chamber to seal the rear end of the firing chamber, to an inoperative position wherein trapping the sealing member in sealing engagement is avoided.

8. A method of converting a cannon, having a firing chamber with a bored rear end and a breech containing therein an original sliding block and a removably cooperating sealing member which, in concert, render the cannon capable of firing only caseless ammunition, to a cannon capable of alternatively firing caseless and cased ammunition, comprising reversibly substituting the original sliding block and the sealing member with another sliding block which is interchangeable with the original sliding block and the sealing member, wherein the another sliding block is for use with cased ammunition having a rear end which is located at the rear end of the firing chamber, wherein when the another sliding block is located in the breech of the cannon, the another sliding block is movable from an operative position, wherein the another sliding block supports and cooperates with the rear end of the cased ammunition to seal the rear end of the firing chamber, to an inoperative position, wherein the rear end of the firing chamber is unsealed.

9. A cannon which includes the kit of claim 1, which renders the cannon capable of alternatively firing cased and caseless ammunition.

* * * * *